United States Patent [19]

Baud

[11] 4,391,432

[45] Jul. 5, 1983

[54] WINCH OPERATING HANDLE

[76] Inventor: Jean F. Baud, 1295, Tannay Vaud, Switzerland

[21] Appl. No.: 259,521

[22] Filed: May 1, 1981

[51] Int. Cl.[3] ..... B66D 1/14

[52] U.S. Cl. ..... 254/365; 254/266; 254/369; 74/542

[58] Field of Search ..... 254/266, 369, 365; 74/503, 504, 547; 114/102, 8

[56] References Cited

U.S. PATENT DOCUMENTS

| | | | |
|---|---|---|---|
| 296,272 | 4/1884 | Burks | 74/547 |
| 652,414 | 6/1900 | Wilson | 74/547 |
| 1,059,884 | 4/1913 | Link | 74/547 |
| 1,247,911 | 11/1917 | Walkup | 74/547 |
| 2,524,508 | 10/1950 | Barnes | 74/547 |
| 3,536,299 | 10/1970 | McCloud et al. | 254/369 |

FOREIGN PATENT DOCUMENTS

| | | | |
|---|---|---|---|
| 848123 | 9/1960 | United Kingdom | 74/547 |

*Primary Examiner*—Philip R. Coe
*Assistant Examiner*—Frankie L. Stinson
*Attorney, Agent, or Firm*—Kane, Dalsimer, Kane, Sullivan and Kurucz

[57] ABSTRACT

An improved winch is provided which is useful in tightening and adjusting ropes, rigging, lines and sheets. The winch includes a rotatable winch member having a central non-circular aperture extending therethrough and a crank member having a shaft portion which has a non-circular cross-section complementary with the shape of the aperture and interengageable therewith so that rotation of the shaft causes rotation of the winch member. A handle member is hinged to the upper end of the shaft portion so as to pivot between an operating position at right angles with the shaft portion to facilitate rotation of the shaft portion and winch member and an inoperative stowable position projecting from the end of the shaft portion in alignment with the axis thereof. The handle portion has a size and configuration so as to fit through the aperture in the winch member so that when it is in an inoperative stowed position the crank member including the handle portion extends downwardly through the aperture in the winch member to its stowed position with only a minimum projection thereabove.

8 Claims, 4 Drawing Figures

WINCH OPERATING HANDLE

BACKGROUND OF THE INVENTION

A typical well known type of a winch handle, for example for use on a sailboat, includes a crank handle which is removably inserted in a socket extending through the winch. The socket in turn has a ratchet connection with the winch through which it extends. When it is desired to rotate the winch, the crank handle is inserted in the socket, rotated about one half turn in one direction to rotate the winch and is then rotated back while the winch remains stationary due to the ratchet connection between the socket member and the winch. When the crank handle is not in use, it is placed on the deck or some convenient nearby place which is the difficulty when virtually all of the existing types of winches available. The winch handle frequently and quite usually becomes misplaced or falls overboard and cannot be found.

One type of solution to this problem is suggested in U.S. Pat. No. 3,536,299. That system shows a handle which is storable when not in use and is shiftable to an operable position for use in operation of the winch. However, there are apparent shortcomings to that design particularly in regard to dependability and operational efficiency as well as in regard to manufacturing cost and longevity. Also, the winch structure requires a special design because the handle is not usable with standard commercially available winches.

Clearly there is room for further improvements in development of an improved winch assembly.

SUMMARY OF THE INVENTION

With the above background in mind, it is among the primary objectives of the present invention to provide an improved winch operating handle that is adaptable for use with conventional winches, is inexpensive and economic to manufacture and use, is dependable and efficiently operable, and is designed for difficult use over a long period of time. It is particularly adaptable for use in the sailing environment where conventionally in the past winch handles were detachable from the winch structure and often misplaced and lost.

The improved winch operating crank of the present invention is permanently assembled with the winch by inserting it in a simple and efficient manner through a socket in the winch structure. It drops downwardly to a recessed substantially unexposed position so that it is out of the way and does not obstruct normal sailing operation. When it is desirable to operate the winch, the crank can be easily and quickly pulled upwardly to an operable exposed position. It is pivoted at a hinged joint in the crank to thereby form a handle so that the winch can be readily rotated from a handle grip on the crank. A shank portion of the crank still retain within the winch structure is serrated or formed with teeth so that it meshes with a socket portion of the winch with a mating surface so as to cause positive rotation of the winch as the handle is rotated.

The crank is designed so that it cannot be displaced or removed from the winch structure and thereby lost. For this purpose, the bottom end of the crank shaft has a removable stop so that the crank can be inserted through the socket in the winch when the stop is removed and after the parts have been assembled the stop can be attached in place by suitable mounting means to prevent the crank from being removed thereafter from the winch.

The crank of the present invention is designed so that interchangeable ball and socket recesses are formed on the proximal portion of the handle and shaft portions of the crank member so as to releasably retain the handle portion in either operative or inoperative positions.

The winch crank of the present invention is designed so that a handle grip is secured to the outer end of the handle member which projects radially beyond the sides of the handle member so as to serve as a stop to rest on the upper portion of the winch member when the crank is in the stored and inoperative position.

The winch crank of the present invention is designed so that a stop is removably secured to the lower end of the crank projecting radially beyond the sides of the crank so as to prevent accidental removal of the crank from the remaining winch structure.

In summary, an improved crank member is provided for use in operating a rotatable winch member which has an aperture with a non-circular portion extending therethrough. The crank member includes a shaft portion which has a non-circular cross-section complementary with the shape of the non-circular portion of the aperture and interchangeable therewith so that rotation of the shaft causes rotation of the winch member. A handle portion is hinged to the upper end of the shaft portion so as to pivot between an operating position at right angles with the shaft portion to facilitate rotation of the shaft portion and winch member and inoperative stowable position projecting from the end of the shaft member in alignment with the axis thereof. The handle portion has a size and configuration so as to fit through the aperture in the winch member so that when it is in inoperative position the crank member including the handle portion extends downwardly through the aperture in the winch member to its stowed position with only a minimum projection thereabove.

With the above objectives among others in mind, reference is made to the attached drawings.

DETAILED DESCRIPTION

Figure 1:
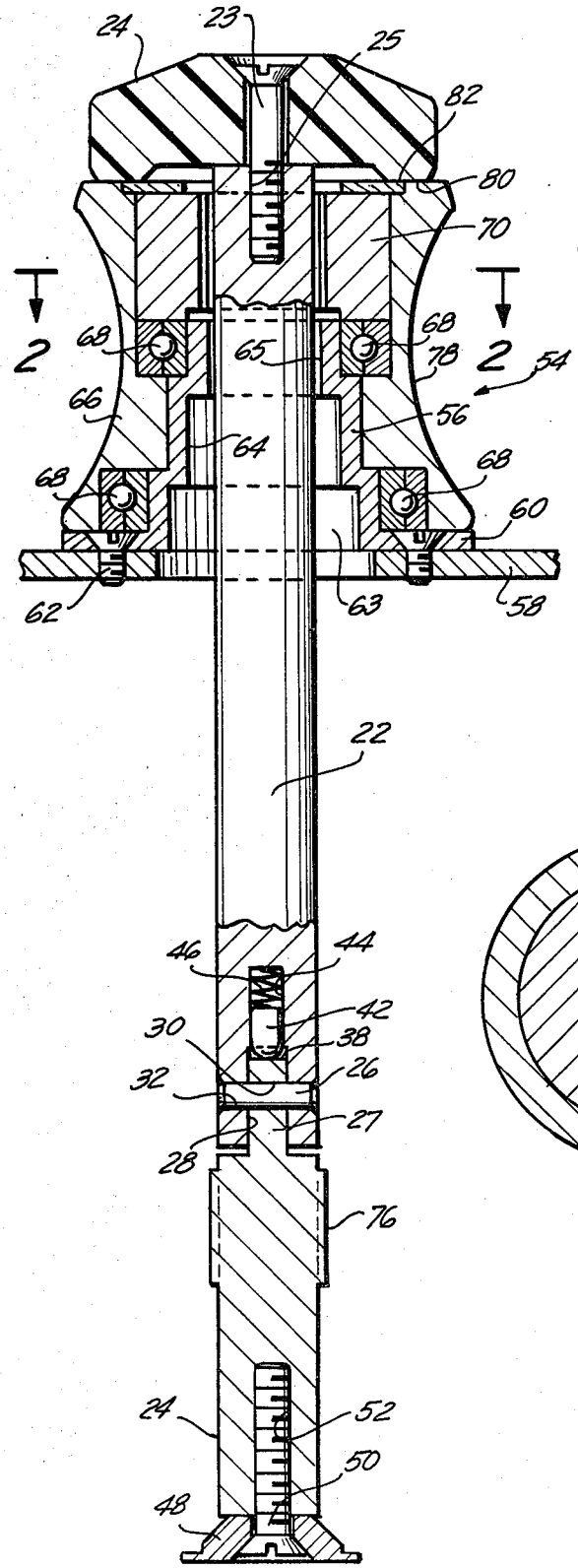
FIG. 1 is a partially sectional elevation view of the winch handle mounted on a winch and in the inoperative recessed position.

Winch crank 20 of the present invention includes an elongated handle portion 22 having an enlarged diameter knob or handle grip 24 on one end. As shown in FIG. 1, enlarged knob 24 is mounted to one end of crank handle 22 by conventional means such as an appropriate screw 23 threadedly interengaged with a threaded aperture 25 in the end of crank handle 22. The other end of handle portion 22 is pivotally mounted or hinged to one end of a shaft portion 24 of crank 20. The interconnection is made by a conventional pivot pin 26 which passes through aligned apertures in the adjoining ends of the shaft portion 24 and handle portion 22. For convenience of assembly, shaft portion 24 has a projecting tongue 27 which is received within a mating groove 28 in the adjoining end of handle portion 22. Tongue 27 has an opening 30 which aligns with opposed openings 32 in the end portion of handle 22.

Tongue 27 is provided with an arcuate outer surface 34 with three spaced socket recesses 36, 38 and 40 formed therein. The middle recess 38 is aligned with the axis of the crank shaft 24. The other two socket recesses 36 and 40 are aligned with each other and opposed on the outer surface 34 of tongue 27. Socket recesses 36 and 40 are displaced approximately 90 degrees with respect to the middle recess 38.

A ball pin 42 is positioned in recess 44 in the lower end of crank handle 22 and projects therefrom in alignment and in position to engage with socket recesses 36, 38 and 40 on tongue 27 of crank shaft 24. The ball pin 24 is biased into engagement with the socket recesses by helical spring 46 captured between the inner end of the ball pin and the inner end of recess 44. Naturally, alternatively, the positions of the socket recesses and the ball pin can be reversed with respect to the crank shaft and the crank handle.

The end of the crank shaft 24 distal from the end connected to the crank handle 22 has a flanged stop 48 mounted thereon in a conventional manner such as by screw 50 threadedly interengaged with a threaded recess 52 in the bottom end of the crank shaft and in aligned aperture through the stop 48. The outer diameter of the flanged stop 48 is larger than the aperture through which the crank shaft 24 passes thereby fixing the crank shaft within the aperture. In fact, the entire crank handle 20 is captured in this manner with the stop 48 preventing complete removal in one direction and the enlarged knob 24 on the upper end of crank handle 22 preventing displacement entirely through the aperture in the other direction.

Crank 20 is designed for use with a conventional type of winch such as the depicted winch assembly 54. The winch assembly includes a winch mounting post 56 mounted to a supporting surface 58 of a conventional structure such as a sailboat deck by means of a base plate 60. Suitable screws 62 can be used for mounting the base plate in a conventional manner. The mounting post 56 has a hollow interior 63 and a through aperture or passageway 64 from top to bottom extending through the base plate 60 and through the open upper end 65 of the mounting post 56. Rotatably mounted on the mounting post 56 is a winch member 66 which is mounted on the mounting post in a conventional manner with suitable conventional bearings 68, for example ball bearing assemblies, provided to permit relative rotation of the winch with respect to the fixed mounting post. A portion of winch 66 extends above the upper end 65 of mounting post 56 and has an inwardly extending engagement portion 70. Portion 70 has a central aperture 72 aligned with the open upper end of mounting post 56 for passage of the crank handle 20 therethrough. The winch member 66 has a surface 74 surrounding the central aperture 72 which is provided with an irregular configuration formed of serrations or teeth conforming to a similar outer surface portion 76 of crank shaft 24. In the depicted embodiment both mating surfaces are serrated in the manner depicted in FIGS. 2 and 4. Thus, when crank shaft portion 76 is interengaged or meshed with the surfaces 74 forming aperture 72 in winch 66, rotation of the shaft will cause rotation of the winch relative the mounting post and accordingly will serve to adjust and shift locations of appropriate ropes, riggings, lines and sheets and the like. Winch member 66 is provided with a conventional arcuate outer surface 78 for this purpose.

Figure 2:
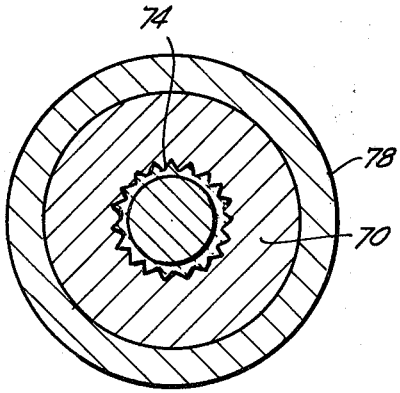
FIG. 2 is a cross sectional view thereof taken along the plane of line 2—2 of FIG. 1.

In use, when inoperative and in stored position, the crank 20 is stored substantially entirely within the winch 54 and the interior of the structure beyond mounting surface 58. The only exposed portion is knob 24 extending above winch 54 and having its undersurface 80 in engagement with the upper surface 82 of the winch. In this position, the crank is stored in a position where it cannot be displaced or lost, is readily accessible, and yet does not interfere with normal activities in the areas surrounding the winch assembly 54. It should be noted that crank handle 22 is aligned with crank shaft 24 to permit extension of both members through the aperture 72 in the winch and the aligned aperture 64 through the mounting post 56. This is accomplished by exerting sufficient rotational force to the handle about pin 26 to cause displacement of ball pin 42 inwardly by engagement with the arcuate surface of socket recess 40, the ball pin 42 moving inwardly and compressing spring 44 until the pin is free of recess 40. Therefore, further rotation of the handle 22 is accomplished until ball pin 42 is in alignment with socket recess 38 whereupon the ball pin 42 will be directed into the arcuate recess 38 by spring 44 to retain the handle 22 in aligned axial position with respect to the shaft 24. The handle 22 can then be dropped into its stored position within the winch 54 and the interior of the supporting structure. This condition is shown in FIGS. 1 and 2.

Figures 3, 4:
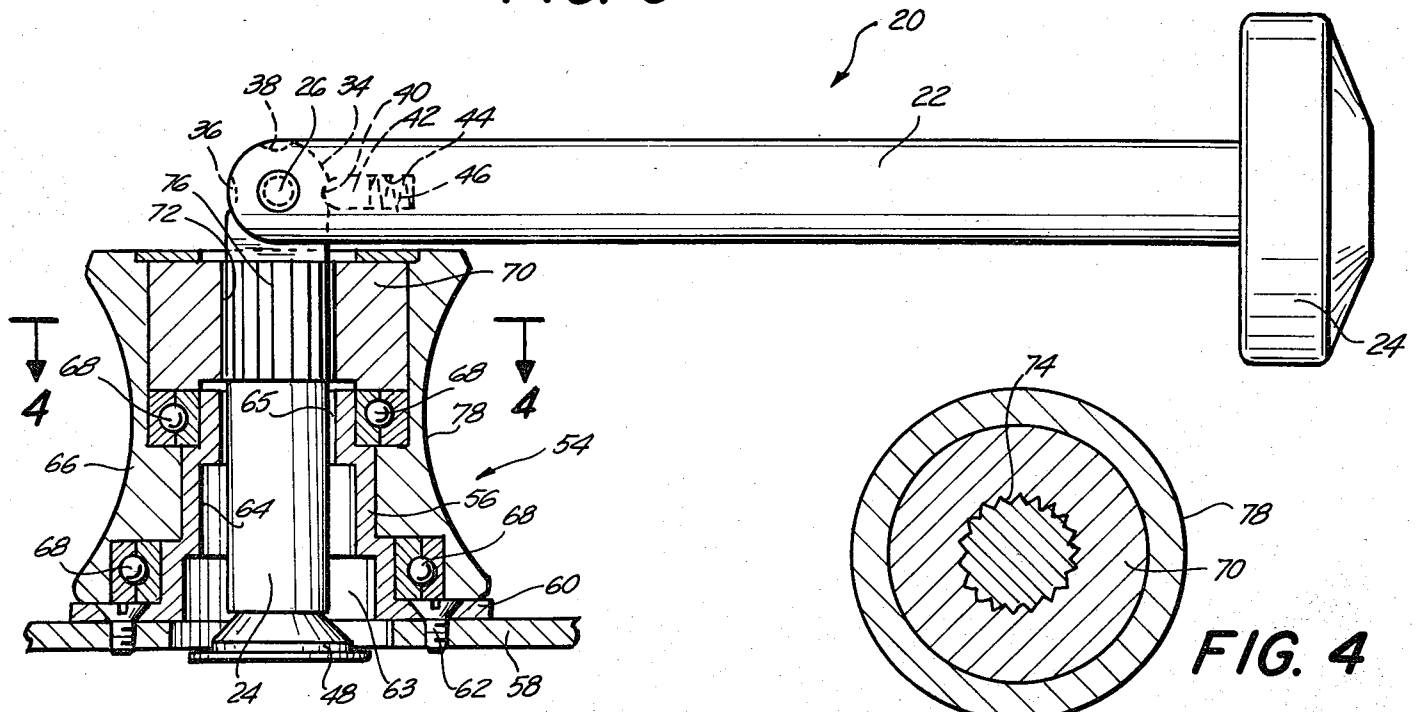
FIG. 3 is a side elevation view thereof with the winch handle having been moved to the operative position for operating the winch.
FIG. 4 is a cross sectional view thereof taken along the plane of line 4—4 of FIG. 3.

When it is desirable to use the winch, the knob 24 is grasped and the crank moved upward directing crank handle 22 out of the upper end of winch 54 to align and mesh serrated crank shaft portion 76 with the serrated surface 74 forming aperture 72 in the winch. Sufficient rotational force about pin 26 is then exerted to cause displacement of ball 42 from socket recess 38, again by compressing spring 44 whereupon further rotation of the handle 22 approximately 90 degrees to the position depicted in FIG. 3 will bring ball pin 42 into alignment with socket recess 40 or alternatively socket recess 36 depending upon the direction of rotation whereupon ball pin 42 will be biased by spring 44 into engagement with the arcuate recess to fix the handle in position for use as shown in FIGS. 3 and 4. Crank handle 22 is then in operating position and can be rotated horizontally about the axis of the winch simultaneously rotating winch member 66 through the meshed interengagement between crank shaft portion 76 and winch surface 74.

After the operational use is complete, the crank can be restored to the inoperative and stowed position in a similar easy and efficient manner. Crank handle 22 is rotated back into axial alignment with crank shaft 24 and the shaft and handle are extended downwardly into the winch assembly structure until they return to the position of FIG. 1. As previously stated, the crank can extend no further due to interengagement between the undersurface of the knob and the upper surface of the winch. In turn, when the crank is shifted to the operative position of FIG. 3, flanged stop 48 engages with the undersurface of base 60 of mounting post 56 of winch assembly 54 and prevents removal of the crank entirely from the winch assembly.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. An improved winch of the type which is useful in tightening and adjusting ropes, rigging, lines and sheets comprising; a winch mounting post having a hollow interior and a through aperture from end to end, means for mounting said post to a fixed support, a winch member having a through passageway and being rotatably mounted on the post with the post extending into the passageway of the winch member, a portion of the winch member extending beyond the post and having the surfaces thereof forming part of the passageway with a non-circular cross-section, the outer surface of the winch member overlying the non-circular cross-section portion and the post extending within the passageway, the outer surface of the winch forming the operable bearing surface for adjusting of the ropes, riggings, lines and sheets, a crank member having a shaft portion which has a non-circular cross-section complementary with the shape of the non-circular portion of the passageway and interengageable therewith so that meshing of the shaft with the surfaces forming the non-circular portion of the passageway and rotation of the shaft causes rotation of the winch member, a handle member hinged to the upper end of the shaft portion so as to pivot between an operating position at right angles with the shaft portion to facilitate rotation of the shaft portion and winch member and an inoperative stowable position projecting from the end of the shaft portion in alignment with the axis thereof, said handle portion having a size and configuration so as to fit through the passageway in the winch member so that when it is in an inoperative stowed position the crank member including the handle portion extends downwardly through the passageway in the winch member, the through aperture in the post, and a communicating opening in the support to its stowed position with only a minimum projection thereabove.

2. An improved winch as set forth in claim 1 in which a handle grip is secured to the outer end of the handle member and which projects radially beyond the sides of the handle member and which serves as a stop resting on the upper surface of the winch member when the crank member is in its stowed position.

3. An improved winch as set forth in claim 1 in which a stop member is removably secured to the lower end of the shaft portion and which projects radially beyond the sides of the shaft portion to prevent accidental removal of the crank member from the winch member.

4. An improved winch as set forth in claim 1 in which interengageable ball and socket recesses are formed on the proximate portions of the handle and shaft portions of the crank member so as to releasably retain the handle portion in either operative or inoperative positions.

5. An improved crank member for use in operating a winch assembly including a winch mounting post having a hollow interior and a through aperture from end to end, means for mounting said post to a fixed support, a winch member having a through passageway and being rotatably mounted on the post with the post extending into the passageway of the winch member, a portion of the winch member extending beyond the post and having the surfaces thereof forming part of the passageway with a non-circular cross-section, the outer surface of the winch member overlying the non-circular cross-section portion and the post extending within the passageway, and the outer surface of the winch forming the operable bearing surface for adjusting the ropes, riggings, lines and sheets, said crank member comprising a shaft portion which has a non-circular cross-section complementary with the shape of the non-circular portion of the passageway and interengageable therewith so that meshing of the shaft with the surfaces forming the non-circular portion of the passsageway and rotation of the shaft causes rotation of the winch member, a handle portion hinged to the upper end of the shaft portion so as to pivot between an operating position at right angles with the shaft portion to facilitate rotation of the shaft portion and winch member and an inoperative stowable position projecting from the end of the shaft member in alignment with the axis thereof, said handle portion having a size and configuration so as to fit through the passageway in the winch member so that when it is in an inoperative position the crank member including the handle portion extends downwardly through the passageway in the winch member, the through aperture in the post, and a communicating opening in the support to a stowed position with only a minimum projection thereabove.

6. An improved crank member as set forth in claim 5 in which a handle grip is secured to the outer end of the handle member and which projects radially beyond the sides of the handle member so as to serve as a stop to rest on the upper portion of the winch member when the crank member is in its stowed position.

7. An improved crank member as set forth in claim 5 in which a stop member is removably secured to the lower end of the shaft portion and which projects radially beyond the sides of the shaft portion so as to prevent accidental removal of the crank member from the winch member.

8. An improved crank member as set forth in claim 5 in which interengageable ball and socket recesses are formed in the proximate portions of the handle and shaft portions of the crank member so as to releasably retain the handle portion in either operative or inoperative position.

* * * * *